US010626534B2

(12) United States Patent
Matsushima et al.

(10) Patent No.: US 10,626,534 B2
(45) Date of Patent: Apr. 21, 2020

(54) SEWING MACHINE AND NON-TRANSITORY COMPUTER-READABLE MEDIUM

(71) Applicant: BROTHER KOGYO KABUSHIKI KAISHA, Nagoya-shi, Aichi-ken (JP)

(72) Inventors: Mika Matsushima, Ichinomiya (JP); Tsuneo Okuyama, Inabe-gun (JP); Aki Yokoyama, Nagakute (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 284 days.

(21) Appl. No.: 15/716,111

(22) Filed: Sep. 26, 2017

(65) Prior Publication Data

US 2018/0016721 A1 Jan. 18, 2018

Related U.S. Application Data

(63) Continuation of application No. PCT/JP2016/069412, filed on Jun. 30, 2016.

(30) Foreign Application Priority Data

Sep. 29, 2015 (JP) ..... 2015-191455

(51) Int. Cl.
*D05B 19/12* (2006.01)
*D05B 87/02* (2006.01)
(Continued)

(52) U.S. Cl.
CPC ..... *D05B 19/12* (2013.01); *D05B 29/06* (2013.01); *D05B 47/00* (2013.01); *D05B 49/00* (2013.01);
(Continued)

(58) Field of Classification Search
CPC ..... D15B 19/12; D05B 29/06; D05B 47/00; D05B 49/00; D05B 55/00; D05B 69/10
See application file for complete search history.

(56) References Cited

U.S. PATENT DOCUMENTS 5,092,257 A * 3/1992 Ogawa ..... D05B 87/02 112/225
6,138,594 A * 10/2000 Kito ..... D05B 19/105 112/277
(Continued)

FOREIGN PATENT DOCUMENTS

JP H11-235493 A 8/1999
JP 2005-073866 A 3/2005
(Continued)

OTHER PUBLICATIONS

Apr. 3, 2018 International Preliminary Report on Patentability issued in International Patent Application No. PCT/JP2016/069412.
(Continued)

*Primary Examiner* — Nathan E Durham
(74) *Attorney, Agent, or Firm* — Oliff PLC

(57) ABSTRACT

A sewing machine includes at least one needle bar, a threading motor, a threading mechanism, a processor, and a memory. The threading mechanism is configured to pass an upper thread through an eye of a sewing needle. The memory is configured to store computer-readable instructions that, when executed by the processor, instruct the processor to perform processes. The processes include making one of a setting that prohibits operation of the threading mechanism and a setting that does not prohibit the operation of the threading mechanism. The processes include switching the operation of the threading mechanism by prohibiting the operation of the threading mechanism in a case where the setting that prohibits the operation of the threading mechanism is made, and permitting the operation of the threading mechanism in a case where the setting that does not prohibit the operation of the threading mechanism is made.

16 Claims, 10 Drawing Sheets

(51) Int. Cl.

| | |
|---|---|
| ***D05B 29/06*** | (2006.01) |
| ***D05B 47/00*** | (2006.01) |
| ***D05B 49/00*** | (2006.01) |
| ***D05B 55/00*** | (2006.01) |
| ***D05B 69/10*** | (2006.01) |

(52) U.S. Cl.
CPC ..... *D05B 55/00* (2013.01); *D05B 69/10* (2013.01); *D05B 87/02* (2013.01)

(56) References Cited

U.S. PATENT DOCUMENTS

| | | | | |
|---|---|---|---|---|
| 7,143,706 | B2 * | 12/2006 | Fujihara ..... | D05B 19/12<br>112/225 |
| 2007/0272136 | A1 | 11/2007 | Shimizu | |
| 2012/0109357 | A1 | 5/2012 | Okuyama | |
| 2014/0290549 | A1 * | 10/2014 | Kato ..... | D05B 19/12<br>112/470.01 |

FOREIGN PATENT DOCUMENTS

| | | | |
|---|---|---|---|
| JP | 2005-73870 | A | 3/2005 |
| JP | 2007-313159 | A | 12/2007 |
| JP | 2012-90868 | A | 5/2012 |

OTHER PUBLICATIONS

Sep. 20, 2016 International Search Report issued in International Patent Application No. PCT/JP2016/069412.

* cited by examiner

| NEEDLE BAR NUMBER | UPPER THREAD DATA | THREADING SETTING | ... |
|---|---|---|---|
| 1 | CARMINE | PROHIBITED | ... |
| 2 | DEEP ROSE | PERMITTED | ... |
| ⋮ | ⋮ | ⋮ | ⋮ |

SEWING MACHINE AND NON-TRANSITORY COMPUTER-READABLE MEDIUM

CROSS-REFERENCE TO RELATED APPLICATION

This application is a continuation application of International Application No. PCT/JP2016/069412, filed Jun. 30, 2016, which claims priority from Japanese Patent Application No. 2015-191455, filed on Sep. 29, 2015. The disclosure of the foregoing application is hereby incorporated by reference in its entirety.

BACKGROUND

The present disclosure relates to a sewing machine that is provided with a threading mechanism and to a non-transitory computer-readable medium.

A sewing machine that is provided with a threading mechanism is known. The threading mechanism with which the sewing machine is provided is configured to pass an upper thread through an eye of a sewing needle that is attached to a lower end of a needle bar.

A plurality of sewing needles exist, with differing thicknesses and eyes of differing sizes, and some of that sewing needles are not suited to the threading mechanism.

Various embodiments of the broad principles derived herein provide a sewing machine and a non-transitory computer-readable medium that make it possible to prohibit the operation of the threading mechanism for a sewing needle that is not suited to the threading mechanism.

Embodiments herein provide a sewing machine that includes at least one needle bar, a threading motor, a threading mechanism, a processor, and a memory. The at least one needle bar is configured to be mounted with a sewing needle. The threading mechanism is coupled to the threading motor. Under the power of the threading motor, the threading mechanism is configured to pass an upper thread through an eye of the sewing needle that is mounted on the at least one needle bar. The memory is configured to store computer-readable instructions that, when executed by the processor, instruct the processor to perform processes. The processes include making one of a setting that prohibits operation of the threading mechanism and a setting that does not prohibit the operation of the threading mechanism. The processes include switching the operation of the threading mechanism by prohibiting the operation of the threading mechanism in a case where the setting that prohibits the operation of the threading mechanism is made, and permitting the operation of the threading mechanism in a case where the setting that does not prohibit the operation of the threading mechanism is made.

Embodiments further provide a non-transitory computer-readable medium that stores computer-readable instructions that are executed by a processor of a sewing machine. The sewing machine is provided with at least one needle bar, a threading motor, and a threading mechanism. The threading mechanism is coupled to the threading motor. Under the power of the threading motor, the threading mechanism is configured to an upper thread through an eye of a sewing needle that is mounted on the at least one needle bar. The computer-readable instructions, when executed, instructing the processor to perform processes. The processes include making one of a setting that prohibits operation of the threading mechanism and a setting that does not prohibit the operation of the threading mechanism. The processes include switching the operation of the threading mechanism by prohibiting the operation of the threading mechanism in a case where the setting that prohibits the operation of the threading mechanism is made, and permitting the operation of the threading mechanism in a case where the setting that does not prohibit the operation of the threading mechanism is made.

BRIEF DESCRIPTION OF THE DRAWINGS

Embodiments will be described below in detail with reference to the accompanying drawings in which.

DETAILED DESCRIPTION

Hereinafter, an embodiment of the present disclosure will be explained with reference to the drawings. A physical configuration of a multi-needle sewing machine (hereinafter simply called the sewing machine) 1 according to the present embodiment will be explained with reference to FIGS. 1 and 2. In the explanation that follows, the upper side, the lower side, the lower left side, the upper right side, the upper left side, and the lower right side in FIG. 1 respectively correspond to the upper side, the lower side, the front side, the rear side, the left side, and the right side of the sewing machine 1.

Figure 1:
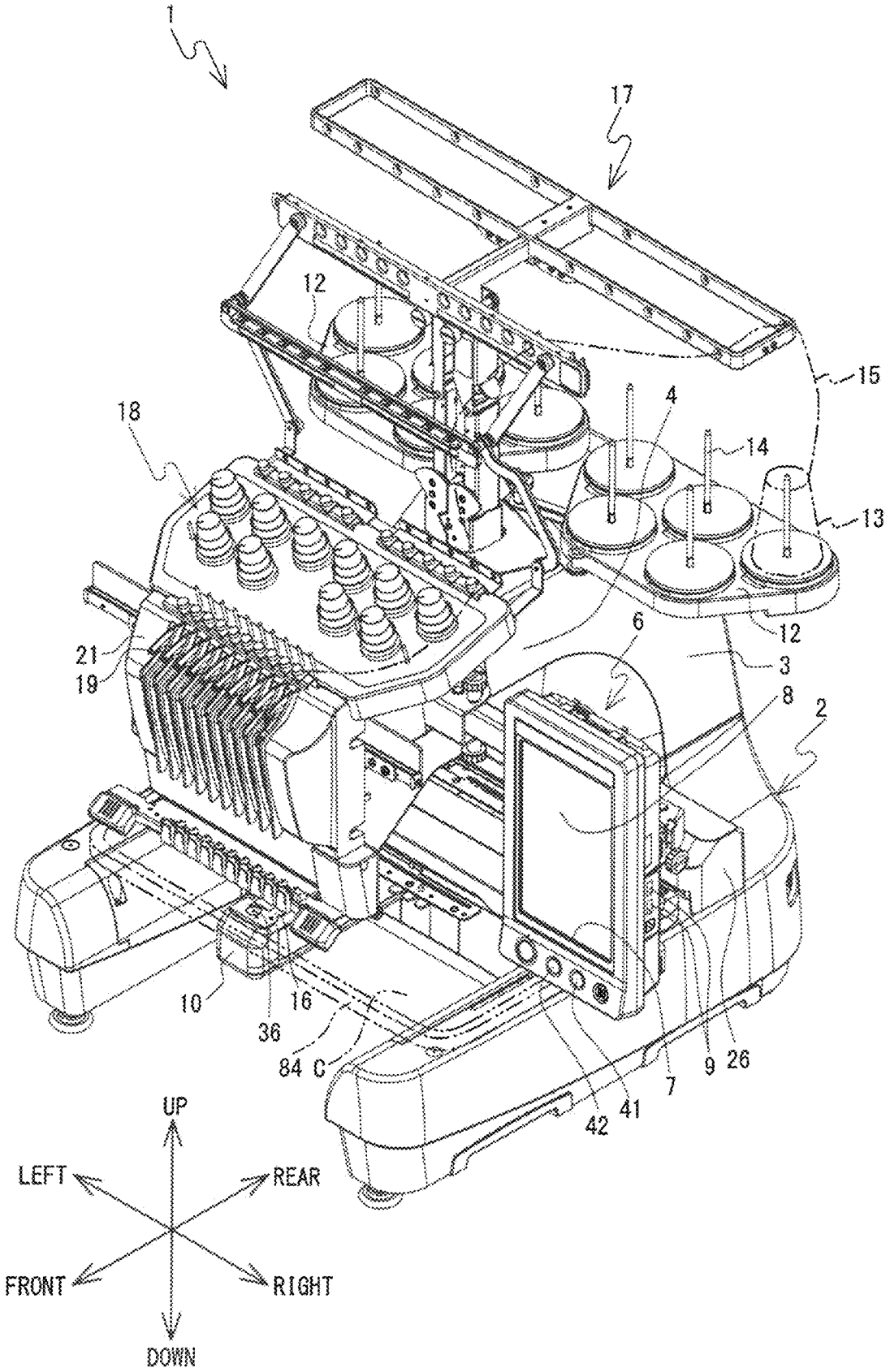
FIG. 1 is a perspective view of a sewing machine.
Figure 2:
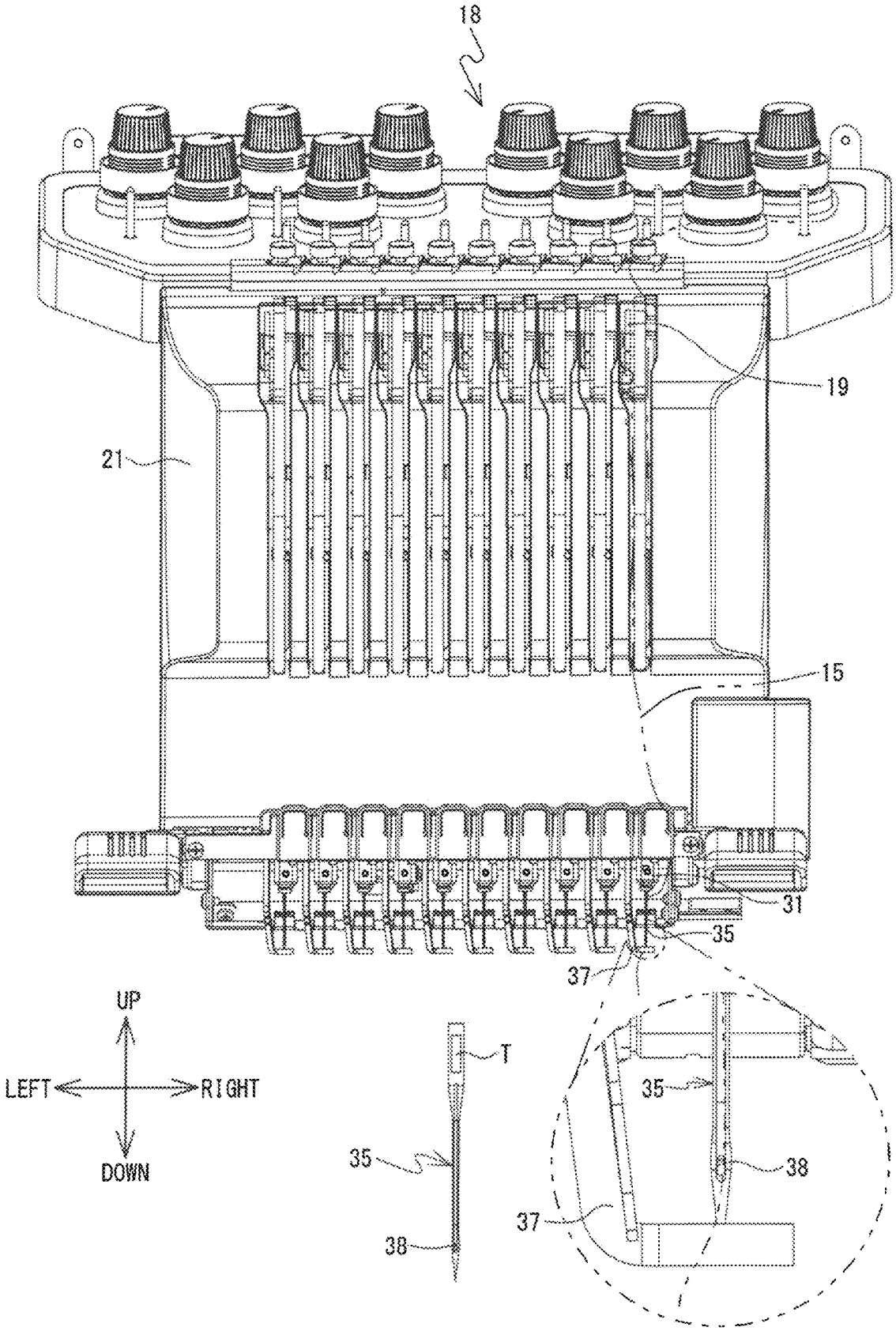
FIG. 2 is a front view of a needle bar case.

As shown in FIGS. 1 and 2, the sewing machine 1 is provided with a support portion 2, a pillar 3, and an arm 4. The support portion 2 supports the entire sewing machine 1. The pillar 3 extends vertically upward from the rear end of the support portion 2. The arm 4 extends toward the front from the upper end portion of the pillar 3. A needle bar case 21 is attached to the front end of the arm 4 such that the needle bar case 21 can move in a left-right direction. Ten needle bars 31 that extend in the up-down direction are disposed at equal intervals in the left-right direction in the interior of the needle bar case 21. A needle bar number is assigned to each one of the ten needle bars 31 in order to identify the individual needle bars 31. In the present embodiment, the needle bar numbers 1 to 10 are assigned in order, starting from the right side of the sewing machine 1. Among the ten needle bars 31, the one needle bar 31 that is in a sewing position (the sewing needle bar) is moved up and down by a needle bar drive mechanism 32 (refer to FIG. 3). A sewing needle 35 (a working needle) can be mounted on the lower end of the needle bar 31. A presser foot 37 may intermittently press down on a workpiece C (for example, a work cloth) in coordination with the up-down movement of the needle bar 31. Each one of the ten needle bars 31 is provided with a reader 43 (refer to FIG. 3) on its lower end. The reader 43 may receive information from a wireless (RFID) tag T, which is provided on the upper end of the sewing needle 35 that is attached to the needle bar 31, and may output a detection signal to a control portion 60 (refer to FIG. 3). The detection signal includes information that specifies the needle bar 31 and information that specifies the type of the sewing needle 35 that is mounted on the specified needle bar 31.

An operation portion 6 is provided on the arm 4. The operation portion 6 is provided with a liquid crystal display (LCD) 7, a touch panel 8, a connector 9, a start/stop switch 41, and a threading switch 42. Various types of information that are used when a user inputs a command, for example, may be displayed on the LCD 7 in the form of an operation screen. The touch panel 8 is used for accepting commands from the user. The user is able to select and set various types of conditions, such as a sewing pattern and sewing conditions, by using a finger or a stylus pen to press a position on the touch panel 8 that corresponds to the position of an input key or the like that is displayed on the LCD 7. Hereinafter, when the user uses a finger or a stylus pen to press a position on the touch panel 8, the operation of doing so will be called a panel operation. The connector 9 is a USB-compliant connector, and the connector 9 can be connected to a USB device 160 (refer to FIG. 3). The start/stop switch 41 is used for issuing commands to start and stop sewing. If the start/stop switch 41 is pressed while the sewing is stopped, the sewing is started. If the start/stop switch 41 is pressed while the sewing is in progress, the sewing is stopped. The threading switch 42 is used for inputting a command to operate a threading mechanism 126, which will be described later. The threading mechanism 126 is coupled to a threading motor 127 and is configured such that, under the power of the threading motor 127, it passes an upper thread 15 through an eye 38 of the sewing needle 35 that is mounted on the needle bar 31 that is positioned in the sewing position.

A tube-shaped cylinder head 10 that extends toward the front from the lower end of the pillar 3 is provided below the arm 4. A shuttle (not shown in the drawings) is provided in the interior of the front end of the cylinder head 10. The shuttle may accommodate a bobbin (not shown in the drawings), around which a lower thread (not shown in the drawings) is wound. A shuttle drive mechanism (not shown in the drawings) is provided in the interior of the cylinder head 10. The shuttle drive mechanism (not shown in the drawings) is configured to rotationally drive the shuttle. A needle plate 16, which is rectangular in a plan view, is provided on the top face of the cylinder head 10. A needle hole 36, through which the sewing needle 35 (refer to FIG. 2) may pass, is provided in the needle plate 16. Among the ten needle bars 31, the one needle bar 31 that is positioned in the sewing position, which is directly above the needle hole 36, is the sewing needle bar.

A Y carriage 26 of an embroidery frame movement mechanism 11 (refer to FIG. 3) is provided below the arm 4. The embroidery frame movement mechanism 11 may support an embroidery frame 84 such that the embroidery frame 84 can be mounted and removed. The embroidery frame 84 may hold the workpiece C. The embroidery frame movement mechanism 11 is configured to move the embroidery frame 84 toward the front and the rear and toward the left and the right, using an X axis motor 132 (refer to FIG. 3) and a Y axis motor 134 (refer to FIG. 3) as drive sources.

Figure 3:
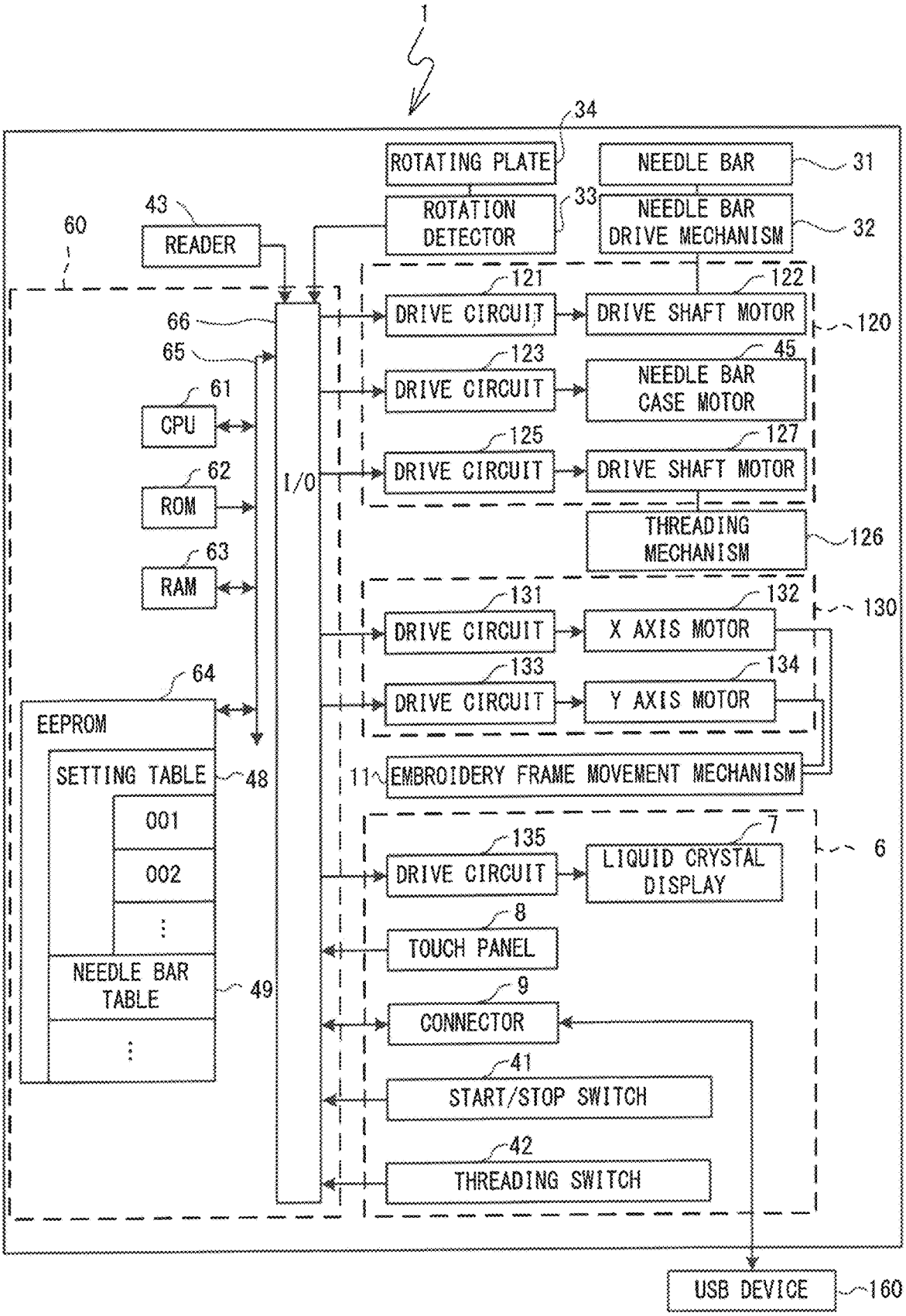
FIG. 3 is a block diagram showing an electrical configuration of the sewing machine.

A left-right pair of thread spool holders 12 are provided on the rear side of the top face of the arm 4. Five thread spool pins 14 are provided on each of the thread spool holders 12. The thread spool pins 14 are pins that extend in the up-down direction. The thread spool pins 14 may support thread spools 13. Ten thread spools 13, the same number as the number of the needle bars 31, can be disposed on the pair of the thread spool holders 12. The upper threads 15 may be supplied from the thread spools 13 that are disposed on the thread spool holders 12. The upper threads 15 may be supplied through thread guide paths to the eyes 38 of the corresponding sewing needles 35 that are mounted on the lower ends of the needle bars 31. The thread guide paths include thread guides 17, tensioners 18, and thread take-up levers 19. Although details are not shown in the drawings, the tensioner 18 is provided in its interior with a rotating plate 34 and a rotation detector 33 that are shown in FIG. 3. The tensioner 18 has a known configuration that is described in Japanese Laid-Open Patent Publication No. 2007-313159, for example, relevant portions of which are herein incorporated by reference. The rotating plate 34 may impart tension to the upper thread 15. The rotation detector 33 may input to the control portion 60 (refer to FIG. 3) an electrical signal that indicates the amount of rotation in the rotating plate 34.

The electrical configuration that performs overall control of the sewing machine 1 will be explained with reference to FIG. 3. As shown in FIG. 3, the sewing machine 1 is provided with the rotation detector 33, the reader 43, a sewing needle drive portion 120, a sewn object drive portion 130, the operation portion 6, and the control portion 60.

The sewing needle drive portion 120 is provided with drive circuits 121, 123, 125, a drive shaft motor 122, a needle bar case motor 45, and the threading motor 127. The drive shaft motor 122 may move the sewing needle bar reciprocally up and down by operating the needle bar drive mechanism 32. The drive circuit 121 may drive the drive shaft motor 122 in accordance with a control signal from the control portion 60. The needle bar case motor 45 may cause the needle bar case 21 to move in the left-right direction. The drive circuit 123 may drive the needle bar case motor 45 in accordance with a control signal from the control portion 60. The threading motor 127 is a pulse motor that is coupled to the threading mechanism 126 and may operate the threading mechanism 126. Although details are not shown in the drawings, the threading mechanism 126 is provided below the front end of the arm 4. The threading mechanism 126 is used for inserting the upper thread 15 (refer to FIGS. 1 and 2) into the eye 38 of the sewing needle 35 on the sewing needle bar. The threading mechanism 126 has a known configuration (refer, for example, to Japanese Laid-Open Patent Publication No. 2005-73866, relevant portions of which are herein incorporated by reference). The drive circuit 125 may drive the threading motor 127 in accordance with a control signal from the control portion 60.

The sewn object drive portion 130 is provided with drive circuits 131, 133, the X axis motor 132, and the Y axis motor 134. The X axis motor 132 may move the embroidery frame 84 in the left-right direction by driving the embroidery frame movement mechanism 11. The drive circuit 131 may drive the X axis motor 132 in accordance with a control signal from the control portion 60. The Y axis motor 134 may move the embroidery frame 84 in the front-rear direction by driving the embroidery frame movement mechanism 11. The drive circuit 133 may drive the Y axis motor 134 in accordance with a control signal from the control portion 60.

The operation portion 6 is provided with the touch panel 8, the connector 9, a drive circuit 135, the LCD 7, the start/stop switch 41, and the threading switch 42. The drive circuit 135 may drive the LCD 7 in accordance with a control signal from the control portion 60. The connector 9 is provided with a function that connects with the USB device 160. The USB device 160 may be a PC or a USB memory, for example.

The control portion 60 is provided with a CPU 61, a ROM 62, a RAM 63, an EEPROM (registered trademark) 64, and an input/output interface (I/O) 66, all of which are connected by a bus 65. The I/O 66 is also connected to the rotation detector 33, the reader 43, the sewing needle drive portion 120, the sewn object drive portion 130, and the operation portion 6.

The CPU 61 is configured to perform the main control of the sewing machine 1. In accordance with various types of programs that may be stored in a program storage area (not shown in the drawings) of the ROM 62, the CPU 61 may perform various types of computations and processing that pertain to sewing. The ROM 62 is provided with a plurality of storage areas, including the program storage area and a pattern storage area, which are not shown in the drawings. Various types of programs for operating the sewing machine 1, including a main program, are stored in the program storage area. The main program is a program for performing main processing, which will be described later. Sewing data are stored in the pattern storage area. The sewing data and embroidery patterns will be explained later. The RAM 63 is a storage element to and from which data can be written and read as desired. The RAM 63 is provided as necessary with storage areas that contain computation results and the like from computational processing that the CPU 61 performs. The EEPROM 64 is a storage element to and from which data can be written and read as desired. Various types of parameters for performing various types of processing for the sewing machine 1 are stored in the EEPROM 64, including a setting table 48 and a needle bar table 49. The setting table 48 contains types of the sewing needles 35 for which the operation of the threading mechanism 126 is prohibited. In the present embodiment, the types of the sewing needles 35 are classified by identifiers that are expressed by three-digit numbers. The needle bar table 49 contains information that pertains to each one of the ten needle bars 31.

An operation that forms stitches on the workpiece C that is held by the embroidery frame 84 will be explained with reference to FIGS. 1 to 3. The embroidery frame 84 that holds the workpiece C is supported by the embroidery frame movement mechanism 11. One of the ten needle bars 31 is selected by moving the needle bar case 21 to the left or the right. The embroidery frame 84 is moved to a specified position by the embroidery frame movement mechanism 11. When the drive shaft (not shown in the drawings) is rotationally driven by the drive shaft motor 122, the needle bar drive mechanism 32 and a thread take-up lever drive mechanism (not shown in the drawings) are driven such that the selected needle bar 31 and the corresponding thread take-up lever 19 are driven up and down. The shuttle drive mechanism is also driven by the rotation of the drive shaft motor 122, such that the shuttle is rotationally driven. The sewing needle 35, the thread take-up lever 19, and the shuttle are thus driven in synchronized manner, such that stitches are formed on the workpiece C.

First threading setting processing will be explained with reference to FIGS. 4 and 5. The first threading setting processing is started in a case where a command to performs setting of the needle bar 31 has been input. In the first threading setting processing, processing is performed that, in accordance with a command from the user, sets whether or not threading is prohibited for the needle bar 31 that has been selected from among the ten needle bars 31. The program that performs the individual processes that are shown in the flowchart in FIG. 4 is stored in the ROM 62 that is shown in FIG. 2 and is executed by the CPU 61.

Figure 4:
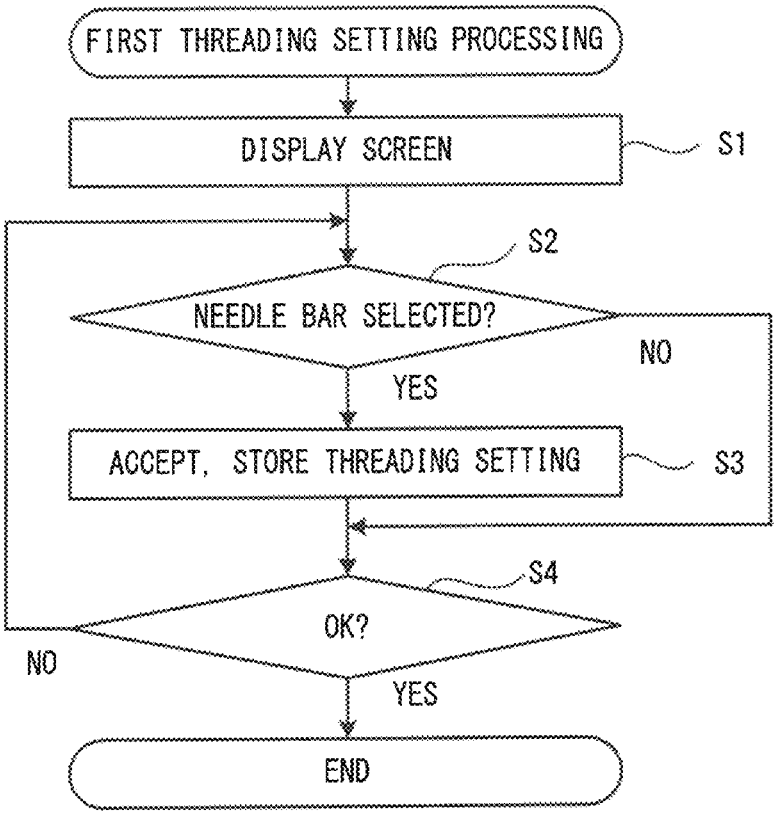
FIG. 4 is a flowchart of first threading setting processing.
Figure 5:
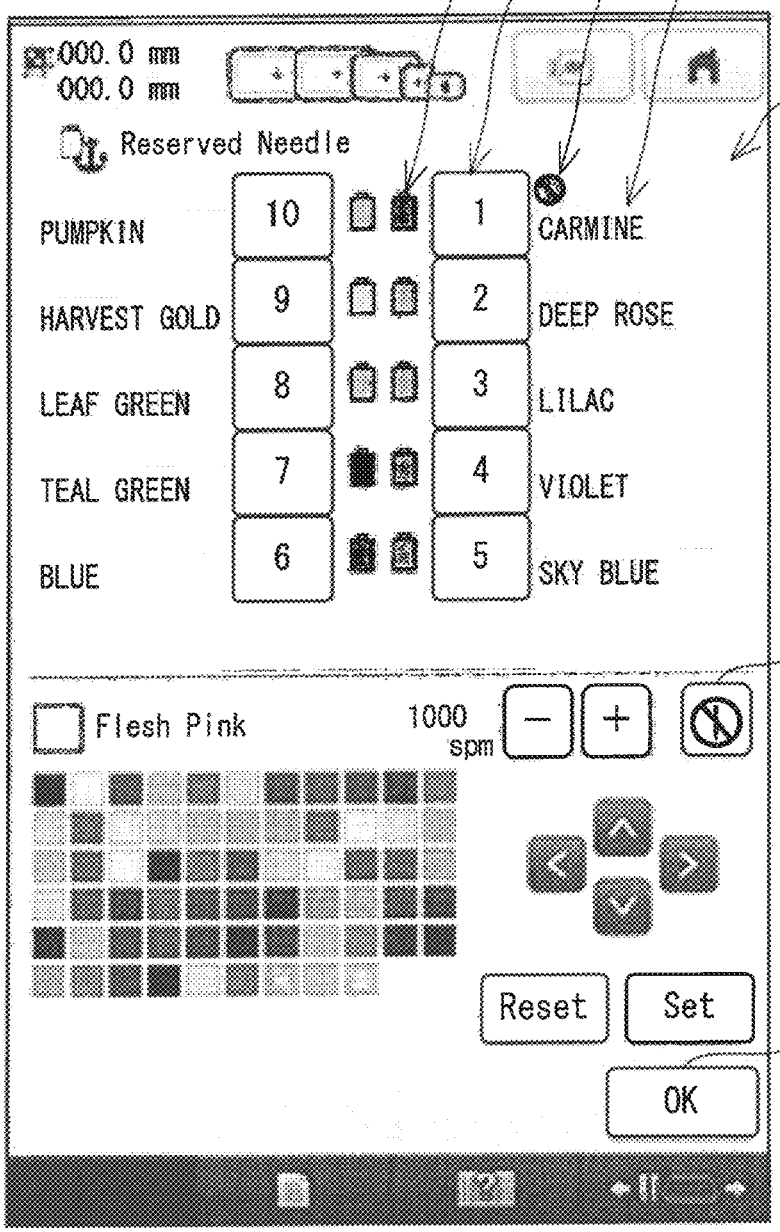
FIG. 5 is an explanatory figure of a needle bar table and a screen that is displayed based on the needle bar table.

As shown in FIG. 4, the CPU 61 first displays a screen on the LCD 7 (Step S1). From the needle bar table 49 that is stored in the EEPROM 64, the CPU 61 acquires various types of information that pertain to the ten needle bars 31. Based on the acquired information, the CPU 61 causes the LCD 7 to display a screen 50 that is shown in FIG. 5. As shown in FIG. 5, the needle bar table 49 contains needle bar numbers, upper thread data, and threading settings. The upper thread data indicate the types of the upper threads 15 (for example, the colors, the thicknesses, the materials, or the like of the upper threads 15) that are set for the needle bars 31 that are indicated by the needle bar numbers. The threading settings indicate whether or not the operation of the threading mechanism 126 is prohibited for the sewing needles 35 that are mounted on the needle bars 31 that are indicated by the needle bar numbers.

The screen 50 includes a needle bar information area 51 and input keys 56, 57. The needle bar information area 51 includes, for each of the ten needle bars 31, a needle bar number key 52, an upper thread display area 53, a threading setting display area 54, and a color name display area 55. The needle bar number key 52 inputs a command that selects the needle bar 31 that is indicated by the needle bar number. The upper thread display area 53 displays the color of the upper thread 15 that has been set for the needle bar 31 that is displayed on the needle bar number key 52. The threading setting display area 54 indicates whether or not the threading setting has been set to "Prohibited" for the needle bar 31 that is displayed on the needle bar number key 52. In a case where the threading setting for the needle bar 31 that is displayed on the needle bar number key 52 prohibits threading, a mark is displayed in the threading setting display area 54 that is the same as a mark on the input key 56, which will be described later. The color name display area 55 displays the color name of the upper thread 15 that has been set for the needle bar 31 that is displayed on the needle bar number key 52. The input key 56 inputs a command that changes the threading setting for the needle bar 31 selected by the needle bar number key 52. The input key 57 inputs a command that terminates the setting of the needle bar 31.

The CPU 61 determines whether or not it has detected that the input key 56 has been selected (Step S2). In a case where the CPU 61 has detected that the input key 56 has been selected (YES at Step S2), the CPU 61 specifies the needle bar 31 selected by the needle bar number key 52, then sets whether or not to prohibit the operation of the threading mechanism 126 for the specified needle bar 31 (Step S3). In the specific example that is shown on the screen 50, in a case where the selected needle bar 31 is the needle bar 31 with the needle bar number 1, the CPU 61 changes the threading setting from "Prohibited" to "Permitted" and updates the needle bar table 49 that is stored in the EEPROM 64. In the specific example that is shown on the screen 50, in a case where the selected needle bar 31 is the needle bar 31 with the needle bar number 2, the CPU 61 changes the threading setting from "Permitted" to "Prohibited" and updates the needle bar table 49. The CPU 61 updates the threading setting display area 54 to match the information in the needle bar table 49 for the selected needle bar 31.

In a case where the CPU 61 has not detected that the input key 56 has been selected (NO at Step S2), as well as after Step S3 is performed, the CPU 61 determines whether or not it has detected that the input key 57 has been selected (Step S4). In a case where the CPU 61 has not detected that the input key 57 has been selected (NO at Step S4), the CPU 61 returns the processing to Step S2. In a case where the CPU 61 has detected that the input key 57 has been selected (YES at Step S4), the CPU 61 terminates the first threading setting processing.

According to the first threading setting processing in FIG. 4, the sewing machine 1 is able to set the threading setting for each one of the plurality of the needle bars 31 to one of "Prohibited" and "Permitted", in accordance with the user's commands.

Figure 6:
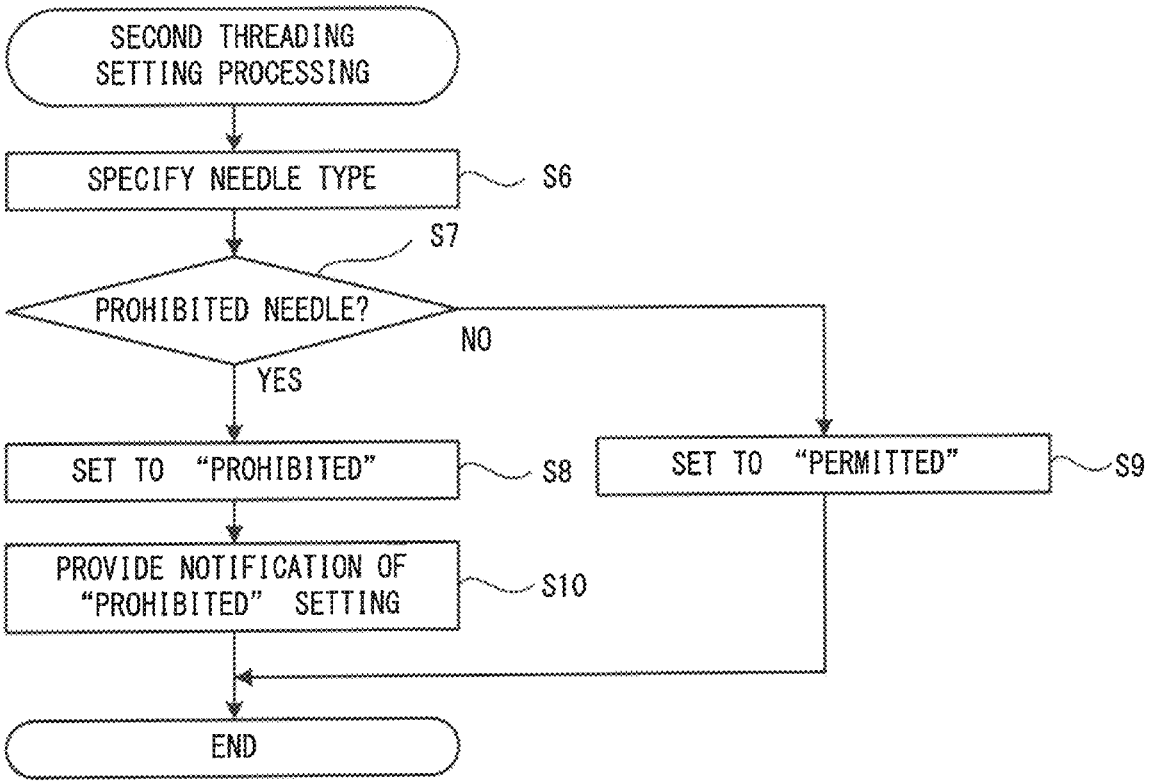
FIG. 6 is a flowchart of second threading setting processing.

Second threading setting processing will be explained with reference to FIG. 6. The second threading setting processing in FIG. 6 is started in a case where any one of the readers 43 that correspond to the individual ones of the ten needle bars 31 has detected that the sewing needle 35 has been mounted. In the second threading setting processing, processing is performed that, in accordance with information input from the reader 43 that indicates the type of the sewing needle 35, sets whether or not threading is prohibited for the needle bar 31, among the ten needle bars 31, for which the information has been input. The program that performs the individual processes that are shown in the flowchart in FIG. 6 is stored in the ROM 62 that is shown in FIG. 2 and is executed by the CPU 61.

As shown in FIG. 6, the CPU 61 specifies the needle bar 31 and the type of the sewing needle 35 that is mounted on the needle bar 31, both of which are indicated by the detection signal that has been output from the reader 43 (Step S6). Based on whether or not the identifier for the sewing needle 35 that was specified at Step S6 is stored in the setting table 48 in the EEPROM 64, the CPU 61 determines whether or not the sewing needle 35 that was specified at Step S6 is a prohibited needle (Step S7). In a case where the identifier for the sewing needle 35 that was specified at Step S6 is stored in the setting table 48, the CPU 61 determines that the sewing needle 35 is a prohibited needle (YES at Step S7). In this case, the CPU 61 sets the threading setting for the needle bar 31 that was specified at Step S6 to "Prohibited" and updates the needle bar table 49 that is stored in the EEPROM 64 (Step S8). The CPU 61 provides notification that the threading setting for the needle bar 31 that was specified at Step S6 has been set to "Prohibited" (Step S10). For example, the CPU 61 causes the LCD 7 to display a message that indicates that the threading setting for the needle bar 31 that was specified at Step S6 has been set to "Prohibited". In a case where the type of the sewing needle 35 that was specified at Step S6 is not a prohibited needle (NO at Step S7), the CPU 61 sets the threading setting for the needle bar 31 that was specified at Step S6 to "Permitted" and updates the needle bar table 49 that is stored in the EEPROM 64 (Step S9). After performing one of Steps S10 and S9, the CPU 61 terminates the second threading setting processing in FIG. 6.

According to the second threading setting processing in FIG. 6, the sewing machine 1 is able to automatically set the threading setting for each one of the plurality of the needle bars 31 to one of "Prohibited" and "Permitted", in accordance with the detection signal that is output from the reader 43.

Threading processing will be explained with reference to FIG. 7. The threading processing is started in a case where a command has been input by a panel operation to select the needle bar 31 for which threading is to be performed. In the threading processing, processing is performed that passes the upper thread 15 through the eye 38 of the sewing needle 35 on the selected needle bar 31. The program that performs the individual processes that are shown in the flowchart in FIG. 7 is stored in the ROM 62 that is shown in FIG. 2 and is executed by the CPU 61.

Figure 7:
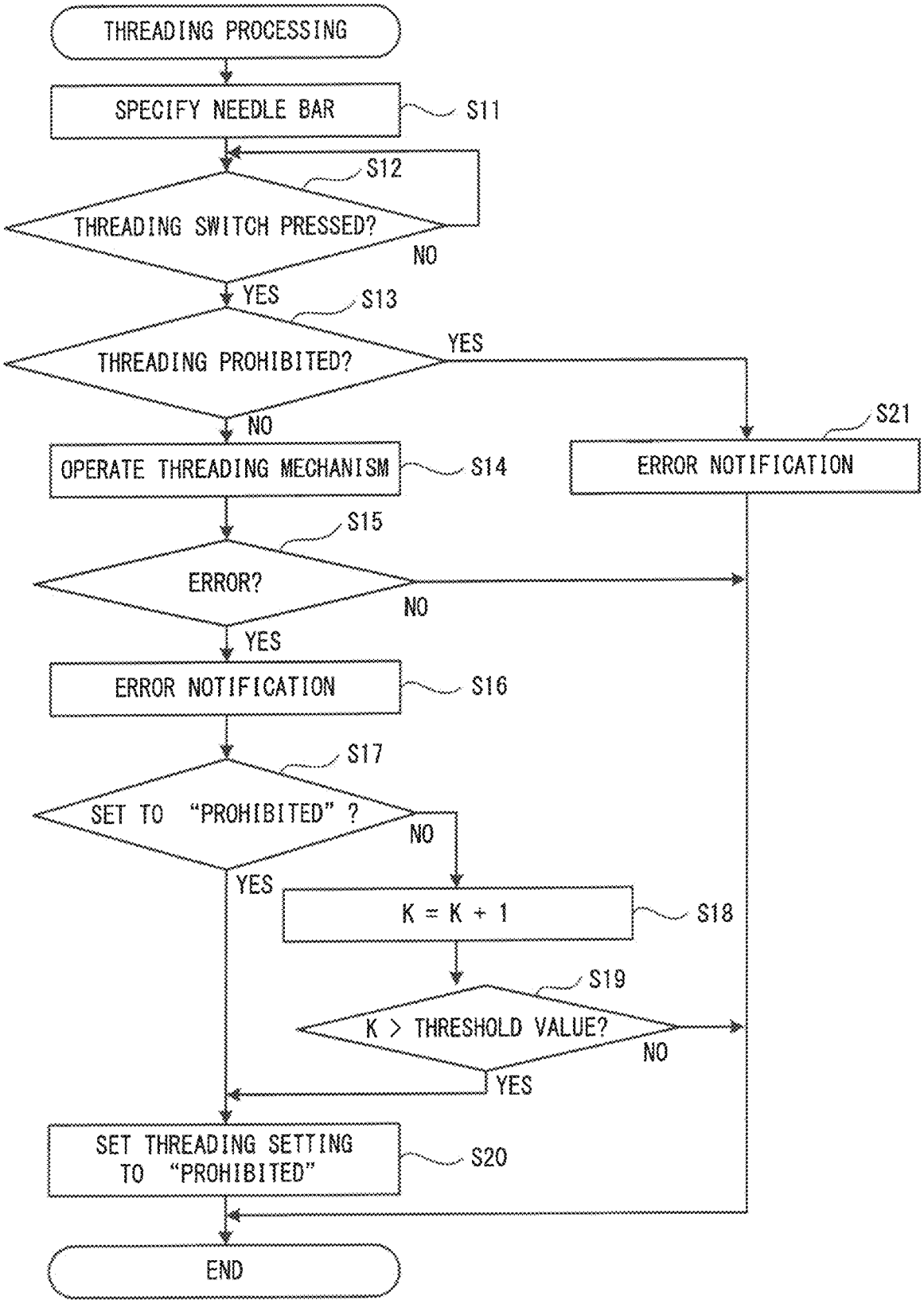
FIG. 7 is a flowchart of threading processing.

As shown in FIG. 7, the CPU 61 specifies the selected needle bar 31 based on the command that has been input by the panel operation (Step S11). The CPU 61 specifies the needle bar 31 with the needle bar number 1, for example. The CPU 61 determines whether or not the pressing of the threading switch 42 has been detected (Step S12). The processing at Step S12 is processing that accepts a command from the user to operate the threading mechanism 126. The CPU 61 waits until the pressing of the threading switch 42 has been detected (NO at Step S12). In a case where the pressing of the threading switch 42 has been detected (YES at Step S12), the CPU 61 determines, by referring to the needle bar table 49 that is stored in the EEPROM 64, whether or not the threading setting for the needle bar 31 that was specified at Step S11 is set to "Prohibited" (Step S13). In the present embodiment, in a case where the command was accepted at Step S12, the CPU 61 prohibits the operation of the threading mechanism 126 in a case where the CPU 61 has determined, based on the needle bar table 49, that the threading setting is set to "Prohibited". In a case where the CPU 61 has not determined that the threading setting is set to "Prohibited", the CPU 61 permits the operation of the threading mechanism 126. In a case where the threading setting for the needle bar 31 that was specified at Step S11 is set to "Prohibited" (YES at Step S13), the CPU 61 provides notification that an error has occurred (Step S21). In a case where the command was accepted at Step S12 and the threading setting for the needle bar 31 that was specified at Step S11 is set to "Prohibited", thus prohibiting the operation of the threading mechanism 126, the processing at Step S21 provides notification to the effect that the operation of the threading mechanism 126 is prohibited. For example, the CPU 61 causes the LCD 7 to display a message that says "The threading setting for the needle bar with the needle bar number 1 is 'Prohibited', so threading cannot be performed." After performing Step S21, the CPU 61 terminates the threading processing.

Figure 8:
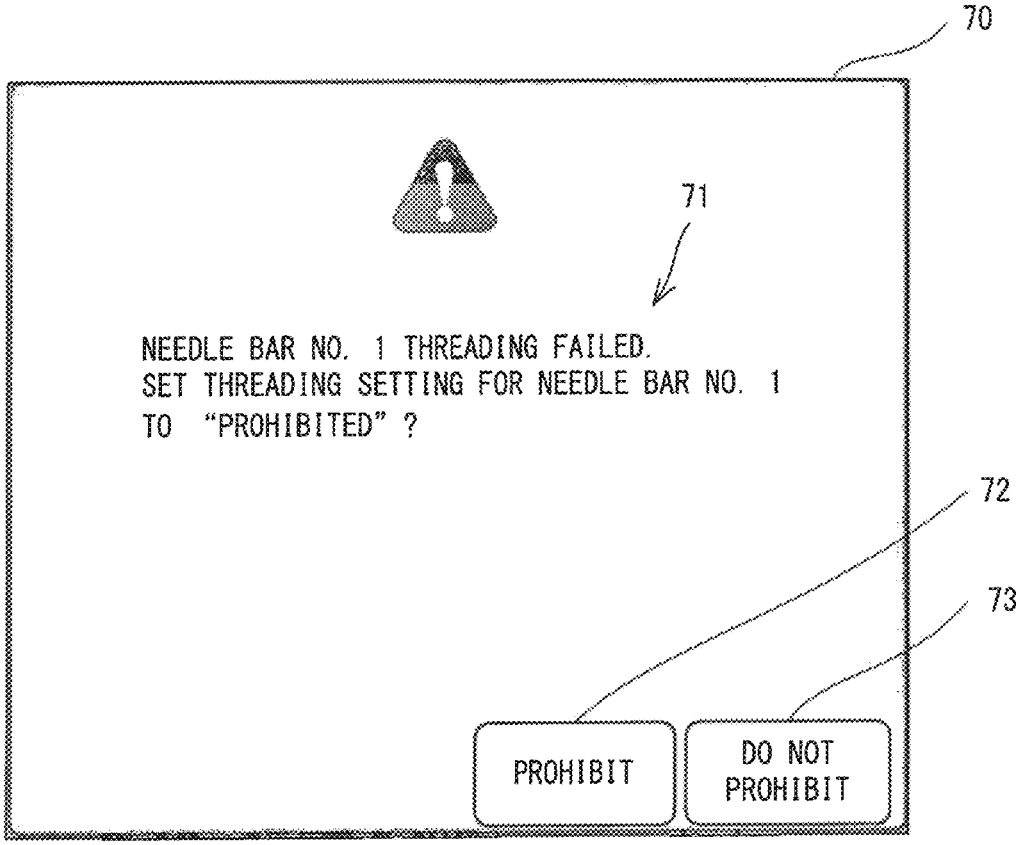
FIG. 8 is an explanatory figure of a screen.

In a case where the threading setting for the needle bar 31 that was specified at Step S11 is set to "Permitted" (NO at Step S13), the CPU 61 moves the needle bar 31 that was specified at Step S11 to the sewing position, then operates the threading mechanism 126 by outputting a control signal to the drive circuit 125 (Step S14). The CPU 61 determines whether or not an error that is related to the operation of the threading mechanism 126 has been detected (Step S15). For example, the CPU 61 detects whether or not the upper thread 15 has been inserted through the eye 38 of the sewing needle 35, based on the signal from the rotation detector 33. In a case where the insertion of the upper thread 15 through the eye 38 of the sewing needle 35 has not been detected even after the threading mechanism 126 has been operated, the CPU 61 determines that an error that is related to the operation of the threading mechanism 126 has been detected. The take another example, the CPU 61 determines that an error has been detected in a case where, although the threading mechanism 126 has been operated, the threading mechanism 126 has come into contact with the sewing needle 35 and a timeout limit has been reached before the threading mechanism 126 has moved to a specified threading position. The CPU 61 may also determine that an error that is related to the operation of the threading mechanism 126 has been detected in a case where it has been detected that the load on the threading motor 127 has reached a specified level. In a case where the occurrence of an error has not been detected (NO at Step S15), the CPU 61 terminates the threading processing. In a case where the occurrence of an error has been detected (YES at Step S15), the CPU 61 provides notification that an error has occurred (Step S16). For example, the CPU 61 causes the LCD 7 to display a screen 70 in FIG. 8. As shown in FIG. 8, the screen 70 includes an area 71 and input keys 72, 73. The area 71 displays an error message. For example, the error message may be "Needle bar No. 1 threading failed. Set threading setting for needle bar No. 1 to 'Prohibited'?" The input key 72 inputs a command that sets the threading setting to "Prohibited" for the needle bar 31 that was specified at Step S11. The input key 73 inputs a command that defers the setting of the threading setting to "Prohibited" for the needle bar 31 that was specified at Step S11.

In a case where the input key 72 has been selected (YES at Step S17), the CPU 61 sets the threading setting for the needle bar 31 that was specified at Step S11 "Prohibited", and updates the needle bar table 49 (Step S20). In a case where the input key 73 has been selected (NO at Step S17), the CPU 61 increments by 1 a variable K that corresponds to the needle bar 31 that was specified at Step S11 (Step S18). The variable K is a variable for counting, for each one of the needle bars 31, the number of times that the threading operation by the threading mechanism 126 has failed. The variable K is stored in the RAM 63 for each one of the needle bars 31 and is initialized when the power supply for the sewing machine 1 is turned off. The CPU 61 determines whether or not the variable K that was incremented at Step S18 is greater than a threshold value (Step S19). The threshold value is set in advance in consideration of factors such as the frequency with which errors related to the operation of the threading mechanism 126 occur, and the threshold value is stored in the EEPROM 64. In the present embodiment, the threshold value is 2. In a case where the variable K is greater than the threshold value (YES at Step S19), the CPU 61 performs the processing at Step S20 in the same manner as described above. When performed after the processing at Step S19, the processing at Step S20 automatically sets the threading setting for the needle bar 31 that was specified at Step S11 to "Prohibited" if the number of detected errors is greater than the threshold value. Note that in a case where the threading setting is automatically set to "Prohibited", a message such as "The threading setting has been set to 'Prohibited' to protect the threading mechanism" may be displayed on the LCD 7, for example. In a case where the variable K is not greater than the threshold value (NO at Step S19), as well as after Step S20 is performed, the CPU 61 terminates the threading processing.

According to the threading processing in FIG. 7, the sewing machine 1 is able to switch automatically between operating and not operating the threading mechanism 126, in accordance with the threading settings that are stored in the needle bar table 49. Even in a case where the user mistakenly presses the threading switch 42 for a needle bar 31 for which the threading setting that is stored in the needle bar table 49 is "Prohibited", it is possible to avoid the operating of the threading mechanism 126.

Sewing processing will be explained with reference to FIG. 9. The sewing processing is started in a case where a command that selects an embroidery pattern to be sewn has been input by a panel operation. The embroidery pattern is made up of a plurality of partial patterns for which the types of the upper threads 15 (for example, the colors, the thicknesses, the materials, or the like of the upper threads 15) are different. The embroidery pattern is sewn in accordance with the sewing data that are stored in the ROM 62. A case will be explained in which, at the time when the sewing processing is started, the upper threads 15 that are shown in FIG. 5 are associated with the needle bars 31 with the needle bar numbers 1 to 10, and five partial patterns that are included in the embroidery pattern will be sewn using the needle bars 31 with the needle bar numbers 1 to 5. The program that performs the individual processes that are shown in the flowchart in FIG. 9 is stored in the ROM 62 that is shown in FIG. 2 and is executed by the CPU 61.

Figure 9:
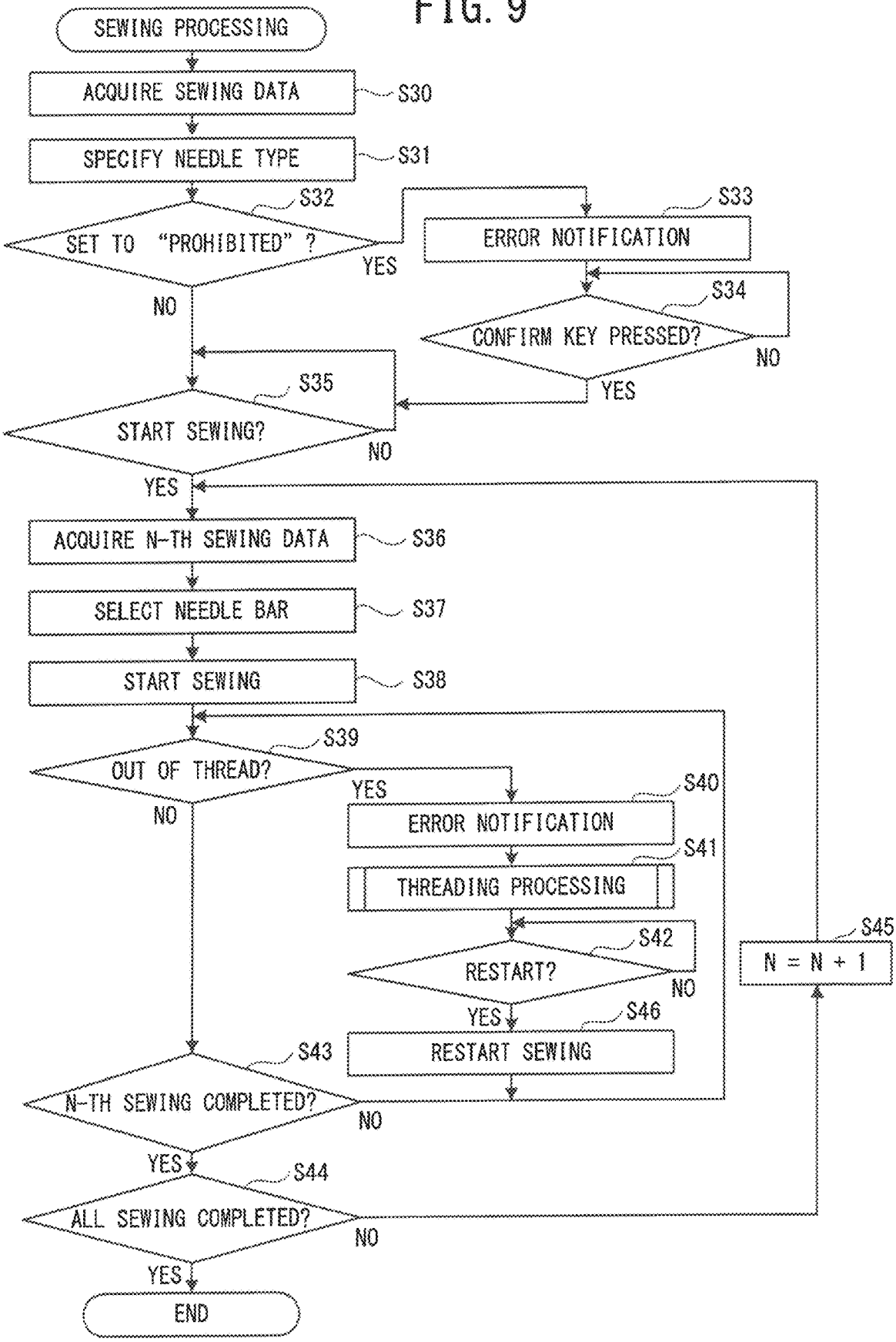
FIG. 9 is a flowchart of sewing processing.
Figure 10:
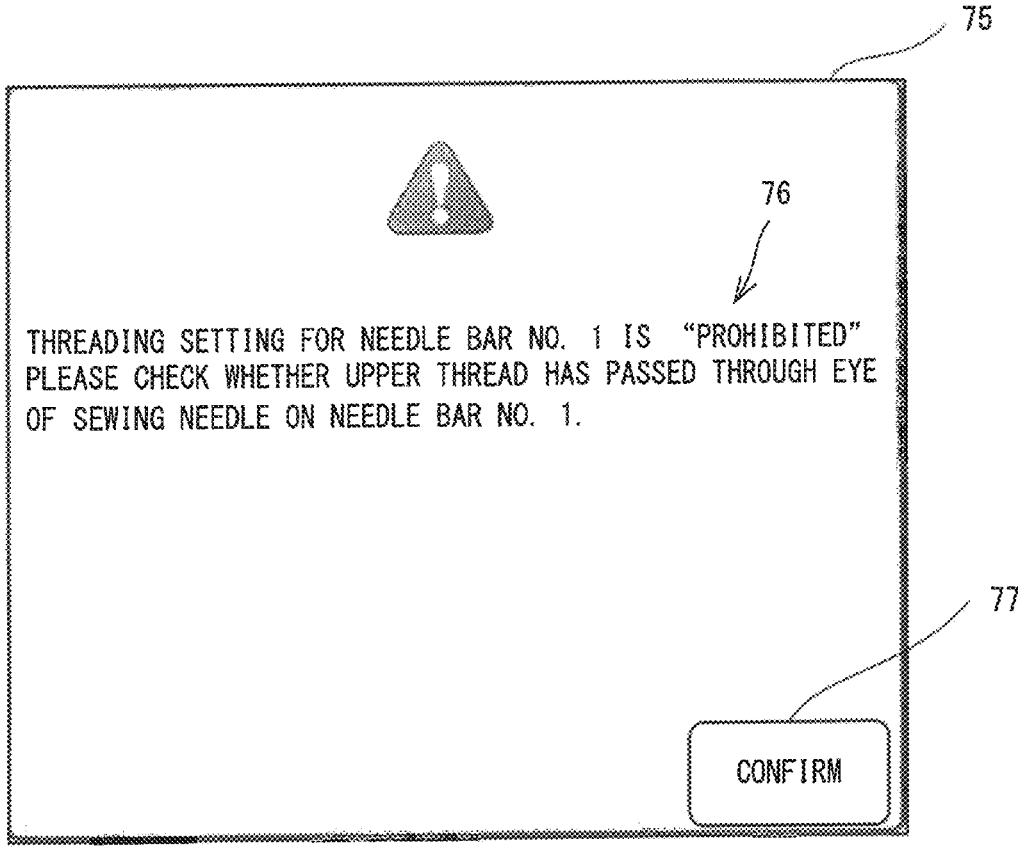
FIG. 10 is an explanatory figure of a screen.

As shown in FIG. 9, the CPU 61 acquires the sewing data for the selected embroidery pattern from the ROM 62 and sets a variable N to 1 (Step S30). The variable N is a variable for acquiring the sewing data for sewing the partial patterns in a sewing order. The sewing data for sewing the partial patterns include upper thread data and coordinate data. The coordinate data are data that specify the positions where the stitches will be formed that make up the partial patterns. The CPU 61, referring to the needle bar table 49, specifies the needle bars 31 with the needle bar numbers 1 to 5 as the needle bars 31 that will be used for sewing the embroidery pattern in accordance with the sewing data that were acquired at Step S30 (Step S31). Referring to the needle bar table 49, the CPU 61 determines whether or not the threading setting for at least one of the needle bars 31 with the needle bar numbers 1 to 5 has been set to "Prohibited" (Step S32). The threading setting for the needle bar 31 with the needle bar number 1 has been set to "Prohibited" (YES at Step S32), so the CPU 61 provides notification indicating that the threading setting for the needle bar 31 with the needle bar number 1 has been set to "Prohibited" (Step S33). For example, the CPU 61 causes the LCD 7 to display a screen 75 in FIG. 10. The screen 75 includes an area 76 and an input key 77. The area 76 displays an error message. The error message includes information that specifies the needle bar 31, among the needle bars 31 that are used for the sewing, for which the threading setting has been set to "Prohibited". For example, the error message may be "Threading setting for needle bar No. 1 is 'Prohibited'. Please check whether upper thread has passed through eye of sewing needle on needle bar No. 1." The input key 77 inputs a command that indicates that the message that is displayed in the area 76 has been checked. The CPU 61 waits until the selecting of the input key 77 is detected (NO at Step S34).

In a case where the threading setting for any one of the needle bars 31 with the needle bar numbers 1 to 5 has been set to "Permitted" (NO at Step S32), as well as in a case where the input key 77 has been detected (YES at Step S34), the CPU 61 determines whether or not the start/stop switch 41 has been pressed to input a command to start the sewing (Step S35). The CPU 61 waits until the command to start the sewing has been input (NO at Step S35). In a case where the inputting of the command to start the sewing has been detected (YES at Step S35), the CPU 61 acquires, from among the sewing data that were acquired at Step S30, the sewing data for sewing the partial pattern that is the N-th in the sewing order (Step S36). Based on the upper thread data that are included in the sewing data that were acquired at Step S36, and on the needle bar table 49, the CPU 61 specifies the needle bar 31 for sewing the N-th partial pattern. The CPU 61 moves the specified needle bar 31 to the sewing position by outputting a control signal to the drive circuit 123 (Step S37). The CPU 61 operates the needle bar 31 for which the upper thread data for the N-th partial pattern have been set and starts the processing that sews the partial pattern onto the workpiece C (Step S38). The CPU 61 outputs control signals to the drive circuit 131 and the drive circuit 133 in accordance with the coordinate data for the N-th partial pattern, thus moving the embroidery frame 84. The CPU 61 outputs a control signal to the drive circuit 121 to operate the drive shaft motor 122 in synchronization the moving of the embroidery frame 84.

The CPU 61 determines whether or not it has detected that the upper thread 15 has run out (Step S39). The running out of the upper thread 15 is detected based on a signal that is output from the rotation detector 33. In a case where the CPU 61 has detected that the upper thread 15 has run out (YES at Step S39), the CPU 61 provides notification that an error has occurred (Step S40). For example, the CPU 61 causes the LCD 7 to display an error message. For example, the error message may be "The upper thread has run out. Please replace it." The CPU 61 performs the threading processing in the same manner as in FIG. 7 (Step S41). In the threading processing that is performed at Step S41, the needle bar 31 that was specified at Step S37 is specified at Step S11 in FIG. 7. In accordance with the error message, the user performs operation to replace the upper thread 15 for the specified needle bar 31. After the threading processing that is the same as in FIG. 7 (Step S41), the CPU 61 waits until the CPU 61 detects that the start/stop switch 41 has been pressed to input a command to restart the sewing (NO at Step S42). In a case where the CPU 61 has detected the input of the command to restart the sewing (YES at Step S42), the CPU 61 restarts the sewing of the N-th partial pattern (Step S46). The CPU 61 outputs control signals to the drive circuit 131 and the drive circuit 133 in accordance with the coordinate data for the N-th partial pattern, thus moving the embroidery frame 84. The CPU 61 outputs a control signal to the drive circuit 121 to operate the drive shaft motor 122 in synchronization the moving of the embroidery frame 84. The CPU 61 returns the processing to Step S39.

In a case where the CPU 61 has not detected that the upper thread 15 has run out (NO at Step S39), the CPU 61 determines whether or not the sewing of the N-th partial pattern has been completed (Step S43). In a case where the sewing of the N-th partial pattern has not been completed (NO at Step S43), the CPU 61 returns the processing to Step S39. In a case where the sewing of the N-th partial pattern has been completed (YES at Step S43), the CPU 61 determines whether or not all of the partial patterns have been sewn (Step S44). In a case where the value of N is not greater than 4 (NO at Step S44), the CPU 61 increments the value of N by 1 (Step S45), then returns the processing to Step S36. In a case where the value of N is 5 (YES at Step S44), the CPU 61 terminates the sewing processing.

In the present embodiment, the sewing machine 1 sets whether or not to prohibit the operation of the threading mechanism 126 for the specified needle bar 31 and stores the threading setting in the needle bar table 49. In the present embodiment, the sewing machine 1 prohibits the operation of the threading mechanism 126 in a case where the threading setting is "Prohibited" and permits the operation of the threading mechanism 126 in a case where the threading setting is "Permitted". Accordingly, the sewing machine 1 is able to switch between prohibiting and permitting the operation of the threading mechanism 126. The sewing machine 1 is able to reliably prohibit the operation of the threading mechanism 126 in a case where the threading setting in the needle bar table 49 has been set to prohibit the operation of the threading mechanism 126.

The sewing machine 1 receives the command to operate the threading mechanism 126 from the threading switch 42. In a case where the sewing machine 1 has received the command from the threading switch 42, the sewing machine 1 determines whether or not the threading setting has been set to "Prohibited". The sewing machine 1 is able to switch automatically between prohibiting and permitting the operation of the threading mechanism 126 in accordance with the command it has received from the threading switch 42. Even in a case where the user has mistakenly input the command to operate the threading mechanism 126 when the sewing needle 35 that is mounted on the needle bar 31 is not suited to the threading mechanism 126, the sewing machine 1 is able to prohibit the operation of the threading mechanism 126 as long as the threading setting has been set appropriately.

The sewing machine 1 is able to detect the occurrence of an error in the processing that uses the threading mechanism 126 to pass the upper thread 15 through the eye 38 of the sewing needle 35. In a specific case where the sewing machine 1 has detected the occurrence of an error, the sewing machine 1 sets the threading setting to prohibit the operation of the threading mechanism 126. The sewing machine 1 is able to automatically set the threading setting to prohibit the operation of the threading mechanism 126 in accordance with the circumstances of the occurrence of an error in the threading mechanism 126. The sewing machine 1 is able to reduce the effort that is required of the user to set whether or not to prohibit the operation of the threading mechanism 126.

The sewing machine 1 counts the number of errors that occur in the threading mechanism 126 for each one of the needle bars 31. In a case where the number of detected errors for the threading mechanism 126 is greater than the threshold value, the sewing machine 1 sets the threading setting to prohibit the operation of the threading mechanism 126. In a case where it is surmised, in accordance with the circumstances of the occurrence of an error in the threading mechanism 126, that the sewing needle 35 that is mounted on the needle bar 31 is not suited to the threading mechanism 126, the sewing machine 1 is able to automatically prohibit the operation of the threading mechanism 126. The sewing machine 1 is able to reduce the effort that is required of the user to set whether or not to prohibit the operation of the threading mechanism 126.

In a case where the threading switch 42 has been pressed and a command has been received, and the threading setting in the needle bar table 49 has been set to "Prohibited", the sewing machine 1 displays on the LCD 7 a message to the effect that the threading setting prohibits the operation of the threading mechanism 126. The sewing machine 1 is able to notify the user of the reason why the sewing machine 1 does not operate the threading mechanism 126 in accordance with the command that was input through the threading switch 42. The notification allows the user to confirm the reason why the threading mechanism 126 is not operated, even though the user has input the command. The user is then able to perform the threading manually, to switch the sewing needle 35 that is mounted on the needle bar 31, or to change the threading setting for the needle bar 31, as necessary.

In a case where the sewing machine 1 detects the type of the sewing needle 35 that is mounted on the needle bar 31, and the detected type of the sewing needle 35 is a type of the sewing needle 35 that is stored in the setting table 48 in the EEPROM 64, the sewing machine 1 sets the threading setting to "Prohibited". In a case where the sewing machine 1 detects that the sewing needle 35 that is mounted on the needle bar 31 is not suited to the threading mechanism 126, the sewing machine 1 is able to automatically set the threading setting to "Prohibited". The sewing machine 1 is able to reduce the effort that is required of the user to set the threading setting to prohibit or permit the operation of the threading mechanism 126.

The sewing machine 1 is provided with the plurality of the needle bars 31 and sets whether or not to prohibit the operation of the threading mechanism 126 for each one of the plurality of the needle bars 31. The sewing machine 1 is able to set whether or not to prohibit the operation of the threading mechanism 126 for each one of the plurality of the needle bars 31. As long as the threading settings in the needle bar table 49 are set appropriately, there is no need for the user to know, for each one of the plurality of the needle bars 31, whether or not it is all right to operate the threading mechanism 126.

Based on the sewing data that were acquired at Step S30, the sewing machine 1 specifies, from among the plurality of the needle bars 31, the needle bar 31 that will be used for the sewing. In a case where the threading setting for the specified needle bar 31 has been set to prohibit the operation of the threading mechanism 126, the sewing machine 1 displays on the LCD 7 a message to the effect that the threading setting has been set to prohibit the operation of the threading mechanism 126. In a case where the threading setting for any one of the needle bars 31 that will be used for the sewing in accordance with the sewing data has been set to prohibit the operation of the threading mechanism 126, the sewing machine 1 provides notification of that fact to the user. The user is able to check the content of the notification on the LCD 7 and can confirm whether or not the upper thread 15 has been passed through the eye 38 of the sewing needle 35 that is mounted on the needle bar 31 that will be used for the sewing. Therefore, the sewing machine 1 is able to avoid the occurrence of an error, after the sewing has been started, that is caused by a failure of the upper thread 15 to be passed appropriately through the eye 38, so the sewing machine 1 is able to reduce the possibility that the sewing time will be extended due to the occurrence of an error.

The sewing machine and a non-transitory computer-readable medium of the present disclosure are not limited to the embodiment that is described above, and various types of modification can be made within the scope of the present disclosure. For example, the modifications (A) to (C) below may be made as desired.

(A) The sewing machine 1 needs only to be a sewing machine that is provided with at least one of needle bar, and the number and arrangement of the needle bars may be modified. The sewing machine 1 may be a sewing machine that is not provided with the embroidery frame movement mechanism 11 and that is able to convey a workpiece using a feed dog. The sewing machine 1 may be a household-use sewing machine and may also be an industrial sewing machine. A notification portion needs only to be capable of providing notification of information, and it may be a speaker, a display device other than an LED or an LCD, or the like, for example. A memory needs only to be capable of storing information, and it may be another storage device, such as the ROM 62, a flash memory, an HDD, an SSD, or the like.

In a case where the sewing data include information that designates the type of the sewing needle 35 that is mounted on the needle bar 31, the CPU 61 may set the threading setting automatically by comparing the setting table 48 with the information in the sewing data that designates the type of the sewing needle 35. In addition to the sewing needle 35, a working needle can also be mounted on the needle bar 31. The working needle is a cutting needle, for example, that pierces and inserts a cut into a sheet-shaped workpiece. The sewing machine 1 may automatically set the threading setting to "Prohibited" for the needle bar 31 on which the cutting needle is mounted. Doing so makes it possible to avoid operating the threading mechanism 126 by mistake for needle bar 31 on which the cutting needle is mounted. The reader 43 may be omitted as necessary. Instead of being provided with the reader 43, the sewing machine 1 may be provided with an image capture portion that is able to capture an image of the sewing needle 35 that is mounted on the lower end of the needle bar 31. In that case, in the second threading setting processing in FIG. 6, the sewing machine 1 may, for example, specify the thickness of the sewing needle 35 or the size of the eye 38 (Step S6), based on a comparison of reference image data and image data that the image capture portion has acquired by capturing an image of the sewing needle 35. The sewing machine 1 may then specify whether or not the threading setting is set to "Prohibited", based on the specification at Step S6 (Step S7). The reference image data may be stored in the EEPROM 64 and may be, for example, image data for an image of a prohibited needle that the image capture portion acquired by image capture. The prohibited needle is a sewing needle that is not suited to the threading mechanism 126 because the eye is too small or the needle itself is too thin.

The sewing machine 1 may also be mechanically configured such that the switching between prohibiting and permitting the operation of the threading mechanism is a mechanical process. For example, in a case where the sewing machine 1 is provided with a threading mechanism that is operated when the user has rotated a lever, the sewing machine 1 may prohibit the operation of the threading mechanism by using a control rod or the like to prohibit the rotating of the lever.

(B) The programs that perform the processing in FIGS. 4, 6, 7, and 9 may be stored in a storage device of the sewing machine 1 until the sewing machine 1 executes the programs. Therefore, the method for acquiring the programs, the route by which the programs are acquired, and the individual devices that store the programs may all be modified as desired. The programs that a processor of the sewing machine 1 executes may be received from another device through a cable or by wireless communication and may be stored in a storage device such as a flash memory or the like. The other device may also be a PC, for example, and it may also be a server that is connected to the sewing machine 1 through a network.

(C) The individual steps in the processing in FIGS. 4, 6, 7, and 9 are not limited to being performed by the CPU 61, and some or all of them may also be performed by another electronic device (for example, an ASIC). The individual steps in the processing that is described above may also be performed by distributed processing by a plurality of electronic devices (for example, a plurality of CPUs). Where necessary, the individual steps in the processing in FIGS. 4, 6, 7, and 9 in the embodiment that is described above can also be performed in a different order, and steps can also be omitted and added. The functions in the embodiment that is described above may also be implemented by having an operating system (OS) or the like that runs in the sewing machine 1 perform some or all of the actual processing, based on commands from the CPU 61 of the sewing machine 1. Such a case is also within the scope of the present disclosure. For example, the modifications described under (C-1) and (C-2) below may be applied to the main processing as desired.

(C-1) The threading setting only needs to be set in at least one of Step S3 of the first threading setting processing in FIG. 4, Steps S8 and S9 of the second threading setting processing in FIG. 6, and Step S20 in FIG. 7. The processing that specifies the type of the sewing needle 35 may be modified as desired in accordance with the device that detects the type of the sewing needle 35.

(C-2) The processing at Steps S10, S21, and S36 may be omitted where necessary. The information in the notification at Steps S10, S21, and S36 may be modified as desired, in accordance with the configuration or the like of the detection portion. The processing at Steps S18 and S19 may be omitted as desired. The threshold value at Step S19 may be modified as desired. The user may be enabled to set the threshold value at Step S19. The user may be enabled to select whether or not to set the threading setting to "Prohibited" in a case where the variable K is greater than the threshold value (YES at Step S19). The processing that accepts the inputs to set and not set the threading setting to "Prohibited" at Step S17 may be omitted as desired. In that case, it is acceptable for the processing at Step S20 to be performed after the processing at Step S15, and it is also acceptable for the threading processing to be terminated after the processing at Step S15, without the processing at Step S20 being performed. The sewing machine 1 may set the threading setting for only some of the needle bars 31 among the plurality of the needle bars 31, and it may also set a common threading setting for all of the needle bars 31 at once.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine comprising:

a plurality of needle bars, each of the plurality of needle bars being configured to be mounted with a sewing needle;

a threading motor;

a threading mechanism coupled to the threading motor, the threading mechanism, via power supplied by the threading motor, being configured to pass an upper thread through an eye of each sewing needle that is mounted on each of the plurality of needle bars;

a processor; and a memory configured to store computer-readable instructions that, when executed by the processor, instruct the processor to perform processes comprising:

generating a threading setting for each one of the plurality of needle bars, the threading setting being one of (i) a setting that prohibits operation of the threading mechanism or (ii) a setting that does not prohibit the operation of the threading mechanism;

storing the threading setting in the memory for each one of the plurality of needle bars;

specifying, from among the plurality of needle bars, a target needle bar; and switching the operation of the threading mechanism by prohibiting the operation of the threading mechanism for the target needle bar in response to the memory storing the threading setting that prohibits the operation of the threading mechanism for the target needle bar, and permitting the operation of the threading mechanism for the target needle bar in response to the memory storing the threading setting that does not prohibit the operation of the threading mechanism for the target needle bar.

2. The sewing machine according to claim 1, wherein the computer-readable instructions further instruct the processor to perform processes comprising:

receiving a command to operate the threading mechanism, and when the command to operate the threading mechanism for the target needle bar is received, (i) determining whether the threading setting that prohibits the operation of the threading mechanism is stored in the memory for the target needle bar, (ii) then prohibiting the operation of the threading mechanism for the target needle bar when the threading setting that prohibits the operation of the threading mechanism is stored in the memory for the target needle bar, and (iii) permitting the operation of the threading mechanism for the target needle bar when the threading setting that does not prohibit the operation of the threading mechanism is stored in the memory for the target needle bar.

3. The sewing machine according to claim 2, further comprising:

a notification device configured to notify information, wherein the computer-readable instructions further instruct the processor to perform processes comprising:

causing the notification device to notify that the operation of the threading mechanism is prohibited, when the command to operate the threading mechanism for the target needle bar is received and the threading setting that prohibits the operation of the threading mechanism is stored in the memory for the target needle bar.

4. The sewing machine according to claim 1, wherein the computer-readable instructions further instruct the processor to perform processes comprising:

detecting an occurrence of an error in processing that uses the threading mechanism to pass the upper thread through the eye of the sewing needle mounted on the target needle bar, and generating the threading setting that prohibits the operation of the threading mechanism for the target needle bar in a specific case of the detecting of the occurrence of the error.

5. The sewing machine according to claim 4, wherein the specific case is a case in which the occurrence of the error is detected not less than a specified number of times for the target needle bar.

6. The sewing machine according to claim 1, wherein:

the memory is configured to store information indicating a type of the sewing needle for which the operation of the threading mechanism is prohibited, and the computer-readable instructions further instruct the processor to perform processes comprising:

specifying a type of the sewing needle that is mounted on the target needle bar, and generating the threading setting that prohibits the operation of the threading mechanism for the target needle bar when the specified type of the sewing needle mounted on the target needle bar is the type of the sewing needle that is stored in the memory.

7. The sewing machine according to claim 1, further comprising:

a notification device configured to notify information, wherein the computer-readable instructions further instruct the processor to perform processes comprising:

acquiring of sewing data, specifying, from among the plurality of needle bars, a needle bar to be used for sewing based on the acquired sewing data, and causing the notification device to notify that the operation of the threading mechanism for the specified needle bar is prohibited when the threading setting that prohibits the operation of the threading mechanism is stored in the memory for the specified needle bar.

8. The sewing machine according to claim 1, further comprising:

a notification device configured to notify of information, wherein the computer-readable instructions further instruct the processor to perform processes comprising:

causing the notification device to notify information including a prohibited needle bar and a mark that is related to the prohibited needle bar, the prohibited needle bar being one of the plurality of needle bars for which the threading setting that prohibits the operation of the threading mechanism is stored in the memory, the mark indicating that the threading setting that prohibits the operation of the threading mechanism for the prohibited needle bar is stored in the memory.

9. A non-transitory computer-readable medium storing computer-readable instructions that are executed by a processor of a sewing machine provided with a plurality of needle bars, a memory, a threading motor, and a threading mechanism, which is coupled to the threading motor, and via power supplied by the threading motor, the threading mechanism is configured to pass an upper thread through an eye of a sewing needle that is mounted on each of the plurality of needle bars, the computer-readable instructions, when executed, instructing the processor to perform processes comprising:

generating a threading setting for each one of the plurality of needle bars, the threading setting being one of (i) a setting that prohibits operation of the threading mechanism or (ii) a setting that does not prohibit the operation of the threading mechanism;

storing the threading setting in the memory for each one of the plurality of needle bars;

specifying, from among the plurality of needle bars, a target needle bar; and switching the operation of the threading mechanism by prohibiting the operation of the threading mechanism for the target needle bar in response to the memory storing the threading setting that prohibits the operation of the threading mechanism for the target needle bar, and permitting the operation of the threading mechanism for the target needle bar in response to the memory storing the threading setting that does not prohibit the operation of the threading mechanism of the target needle bar.

10. The non-transitory computer-readable medium according to claim 9, wherein the computer-readable instructions further instruct the processor to perform processes comprising:

receiving a command to operate the threading mechanism, and when the command to operate the threading mechanism for the target needle bar is received, (i) determining whether the threading setting that prohibits the operation of the threading mechanism is stored in the memory for the target needle bar, (ii) then prohibiting the operation of the threading mechanism for the target needle bar when the threading setting that prohibits the operation of the threading mechanism is stored in the memory for the target needle bar, and (iii) permitting the operation of the threading mechanism for the target needle bar when the threading setting that does not prohibit the operation of the threading mechanism is stored in the memory for the target needle bar.

11. The non-transitory computer-readable medium according to claim 10, wherein the computer-readable instructions further instruct the processor to perform processes comprising:

causing a notification device of the sewing machine to notify that the operation of the threading mechanism is prohibited, when the command to operate the threading mechanism for the target needle bar is received and the threading setting that prohibits the operation of the threading mechanism is stored in the memory for the target needle bar, the notification device being configured to notify information.

12. The non-transitory computer-readable medium according to claim 9, wherein the computer-readable instructions further instruct the processor to perform processes comprising:

detecting an occurrence of an error in processing that uses the threading mechanism to pass the upper thread through the eye of the sewing needle mounted on the target needle bar, and generating the threading setting that prohibits the operation of the threading mechanism for the target needle bar in a specific case of the detecting of the occurrence of the error.

13. The non-transitory computer-readable medium according to claim 12, wherein the specific case is a case in which the occurrence of the error is detected not less than a specified number of times for the target needle bar.

14. The non-transitory computer-readable medium according to claim 9, wherein the computer-readable instructions further instruct the processor to perform processes comprising:

specifying a type of the sewing needle that is mounted on the target needle bar, and the generating the threading setting that prohibits the operation of the threading mechanism when the specified type of the sewing needle mounted on the target needle bar is a type of the sewing needle that is stored in the memory of the sewing machine, the memory being configured to store information indicating a type of the sewing needle for which the operation of the threading mechanism is prohibited.

15. The non-transitory computer-readable medium according to claim 9, wherein the computer-readable instructions further instruct the processor to perform processes comprising:

acquiring of sewing data, specifying, from among the plurality of needle bars, a needle bar to be used for sewing based on the sewing data, and causing a notification device of the sewing machine to notify that the operation of the threading mechanism for the specified needle bar is prohibited, when the threading setting that prohibits the operation of the threading mechanism is stored in the memory for the specified needle bar, the notification device being configured to notify information.

16. The non-transitory computer-readable medium according to claim 9, wherein the computer-readable instructions further instruct the processor to perform processes comprising:

causing a notification device of the sewing machine to notify information including a prohibited needle bar and a mark that is related to the prohibited needle bar, the prohibited needle bar being one of the plurality of needle bars for which the threading setting that prohibits the operation of the threading mechanism is stored in the memory, the mark indicating that the threading setting that prohibits the operation of the threading mechanism for the prohibited needle bar is stored in the memory.

* * * * *